US006397023B1

(12) United States Patent
Underwood et al.

(10) Patent No.: US 6,397,023 B1
(45) Date of Patent: May 28, 2002

(54) TECHNIQUES FOR ACHIEVING CORRECT ORDER IN PRINTER OUTPUT

(75) Inventors: John A Underwood, Sant Cugat Del Valles (ES); Geoff Wotton, Battleground, WA (US); Laurent A. Regimbal, Eagle, ID (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/588,442

(22) Filed: Jun. 6, 2000

(51) Int. Cl.[7] ..... G03G 15/01; B41J 2/01

(52) U.S. Cl. ..... 399/82; 347/104; 399/401; 399/405

(58) Field of Search ..... 399/82, 85, 381, 399/397, 401, 405; 347/101, 104, 153, 221, 262, 264; 271/184, 186

(56) References Cited

U.S. PATENT DOCUMENTS 4,692,020 A * 9/1987 Tsujihara ..... 399/401
4,750,016 A * 6/1988 Kusumoto et al. ..... 399/405
4,780,745 A * 10/1988 Kodama ..... 399/401
4,945,390 A * 7/1990 Hasegawa et al. ..... 399/405
5,377,970 A * 1/1995 Kikuchi
5,418,607 A * 5/1995 Tani ..... 399/401 X
5,708,954 A * 1/1998 Ando et al. ..... 399/401 X
5,839,044 A * 11/1998 Taruki ..... 399/401 X
5,862,435 A * 1/1999 Suzumi et al. ..... 399/405 X

* cited by examiner

*Primary Examiner*—Sandra Brase

(57) ABSTRACT

Techniques for providing a face down orientation of printed media at a normally face up output of a printer. One technique achieves correct order orientation in a printer having a duplexing function, and includes printing a page of the print job at a print area, passing the page through a duplexing media path to reorient the page in a page down orientation, passing the page through the print area in the page down orientation without conducting a printing operation, and passing the page from the print area to an output area in correct order orientation. Another technique includes advancing a page from an input source to a print area, conducting printing operations on the page at the print area, transporting the page away from the print area, diverting the page into an auxiliary media path portion and transporting the page, leading edge first, until a trailing edge of the page passes a diverter location, transporting the page in the reverse direction such that the trailing edge now becomes the leading edge, and diverting the present leading edge of the page along a media path leading to the normally face up output, such that the page is presented to the normally face down output in a face down orientation.

12 Claims, 7 Drawing Sheets

TECHNIQUES FOR ACHIEVING CORRECT ORDER IN PRINTER OUTPUT

TECHNICAL FIELD OF THE INVENTION

This invention relates to printers, and more particularly to techniques for providing printer output in a desired order.

BACKGROUND OF THE INVENTION

High-end printers on the market today are typically available, either as a standard feature or more often an optional feature, with a duplexer system to enable two-sided printing. A primary purpose of a duplexer is to turn-over the print media after printing on a first or "front" side, so that an image can be placed on the second or "back" side of the print media. Typically, for the example of a laser printer, the print media starts out in the printer input tray, is picked from the input tray, and transported to a printer registration assembly. After being deskewed by the registration assembly, the media is then transported through the imaging and fusing areas to a diverter assembly. The diverter assembly typically has two moveable paper guides that determine by their position the flow of the media. The print engine firmware controls electric solenoids to determine the position of these guides. The first guide or diverter determines whether the sheet is diverted into the duplexer, or is allowed to continue on to one of the output destinations. The second diverter determines whether the sheet will be diverted to the face-down output bin or will continue straight out of the engine to the face-up output bin.

The face-up output bin is typically used for heavy media, envelopes, overhead transparency (OHT) stock and labels in a conventional printer. This output bin also gives the printer an essentially "straight-through" paper path if media is printed from the multi-purpose tray.

A problem arises when output devices are attached to the printer. The most convenient location to do this is at the face-up output bin, since this is located on the side of the printer. This presents a problem, however, in that face-up output is inherently in reverse order; i.e. page 1 is printed first and is on the bottom of the output stack (face-up). This can be addressed by sending the print job to the printer in reverse order, but this has the disadvantage of large time delays for large jobs using today's software, due to the large memory requirements.

To address the problem, typically the pages are received face-up in order 1–N, and each page is flipped to a face-down orientation to preserve the correct order. This flipping is done by the output device.

It would therefore be an advantage to provide a simple way to deliver printer output in correct order.

SUMMARY OF THE INVENTION

Techniques are described for providing a face down orientation of printed media at a normally face up output of a printer. One technique achieves correct order orientation of a print job in a printer having a duplexing function, and includes printing a page of the print job at a print area; passing the page through a duplexing media path to reorient the page in a page down orientation; passing the page through the print area in the page down orientation without conducting a printing operation; and passing the page from the print area to an output area in correct order orientation.

A second technique according to another aspect of the invention achieves face down orientation of a printed page at a normally face up output area of a printer. This technique includes advancing a page from an input source to a print area; conducting printing operations on the page at the print area; transporting the page away from the print area; diverting the page into an auxiliary media path portion and transporting the page, leading edge first, until the trailing edge of the page passes a diverter location; transporting the page in the reverse direction such that the trailing edge now becomes the leading edge, and diverting the present leading edge of the page along a media path leading to the normally face up output, such that the page is presented to the normally face up output in a face down orientation.

BRIEF DESCRIPTION OF THE DRAWINGS

These and other features and advantages of the present invention will become more apparent from the following detailed description of an exemplary embodiment thereof, as illustrated in the accompanying drawings, in which.

DETAILED DESCRIPTION OF THE PREFERRED EMBODIMENTS

Figure 1:
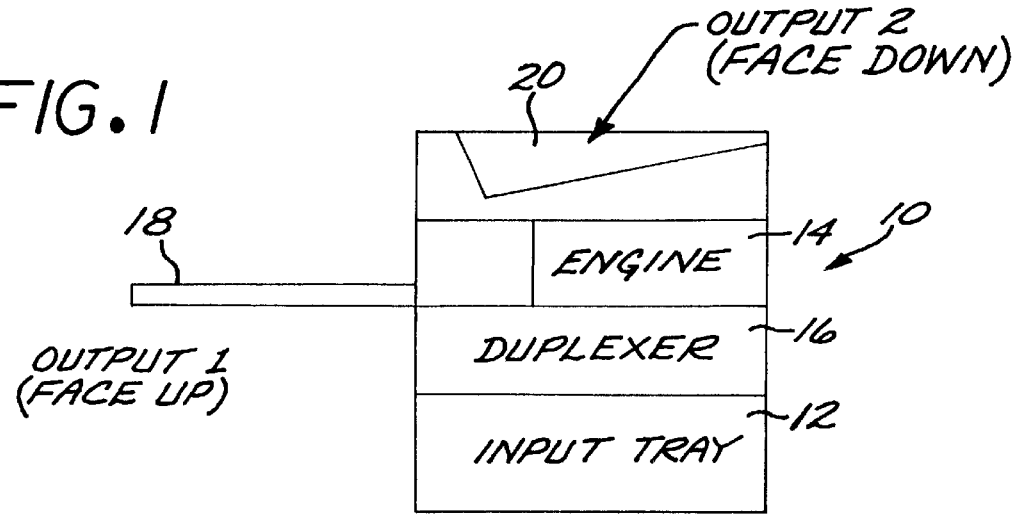
FIG. 1 is a schematic depiction of a printer with a duplexing function which can be adapted to employ this invention.

FIG. 1 is a schematic depiction of a printer 10 which can be adapted to employ this invention. The printer 10 has an input tray 12 which holds a stack of print media, a print engine 14, a duplexer 16, and two outputs 18 and 20. The print engine can be a laser print engine, an ink-jet print engine, or in general any type of print engine. Output 18 is at a distal end of a media path through the print engine, and holds the output in a face-up orientation, i.e. the side of the print media just printed by the print engine faces up when delivered to the output 18, when the printer is operating in a face-up print mode. The second output 20 is a face-down output, at the end of a curved path from the print engine output, and the curved path results in the printed side of the sheet being delivered in a downward orientation.

The duplexer 16 is an assembly which can be operated in a user-commanded duplexer mode to allow both sides of the print media to receive a printed image. When in the duplexer mode, the output from the print engine is diverted from the output path into the duplexer path, which passes the output sheet around to the input to the print engine, this time in the reverse orientation, such that the reverse side of the print medium is now facing up. The print engine is then commanded to print the next page of the print job onto the reversed side of the sheet. Once the reverse side printing is completed, the sheet is output to either the face up output 18 or the face down output 20.

To the extent just described, the operation of the printer 10 is known in the art. In accordance with an aspect of the invention, the printer 10 is operated in such a way as to provide a face-down output in the output 18. This can be useful when an output device such as a sorter is attached to the printer at the output 18. This mode of operation uses the duplexer 16 to feed a sheet through the print engine again, after one side has been printed with an image. However, on this second pass through the print engine, no printing is done, and the sheet is passed directly through the engine to the output path and output 18. In this manner, the print output at output 18 will be face down and in the correct print order.

The advantage of this technique for achieving correct print order at output 18 is that no additional devices are needed to flip the print output. The printer controller can be programmed to achieve this correct print order in response to commands from a host computer or a manual front panel command. Simply by invoking the duplexer operation while refraining from printing onto the sheet as it passed through the print engine during the duplexer pass, the sheet orientation will be reversed, and the correct (face down) print order will be achieved at the output 18. This can provide a second face down output, i.e. in addition to output 20, and eliminates the need for a separate flipper apparatus to be included in an output device which receives the print output at 18. The disadvantage of this technique is that the throughput of the printer will be reduced during this face down mode of operation.

Figure 2:
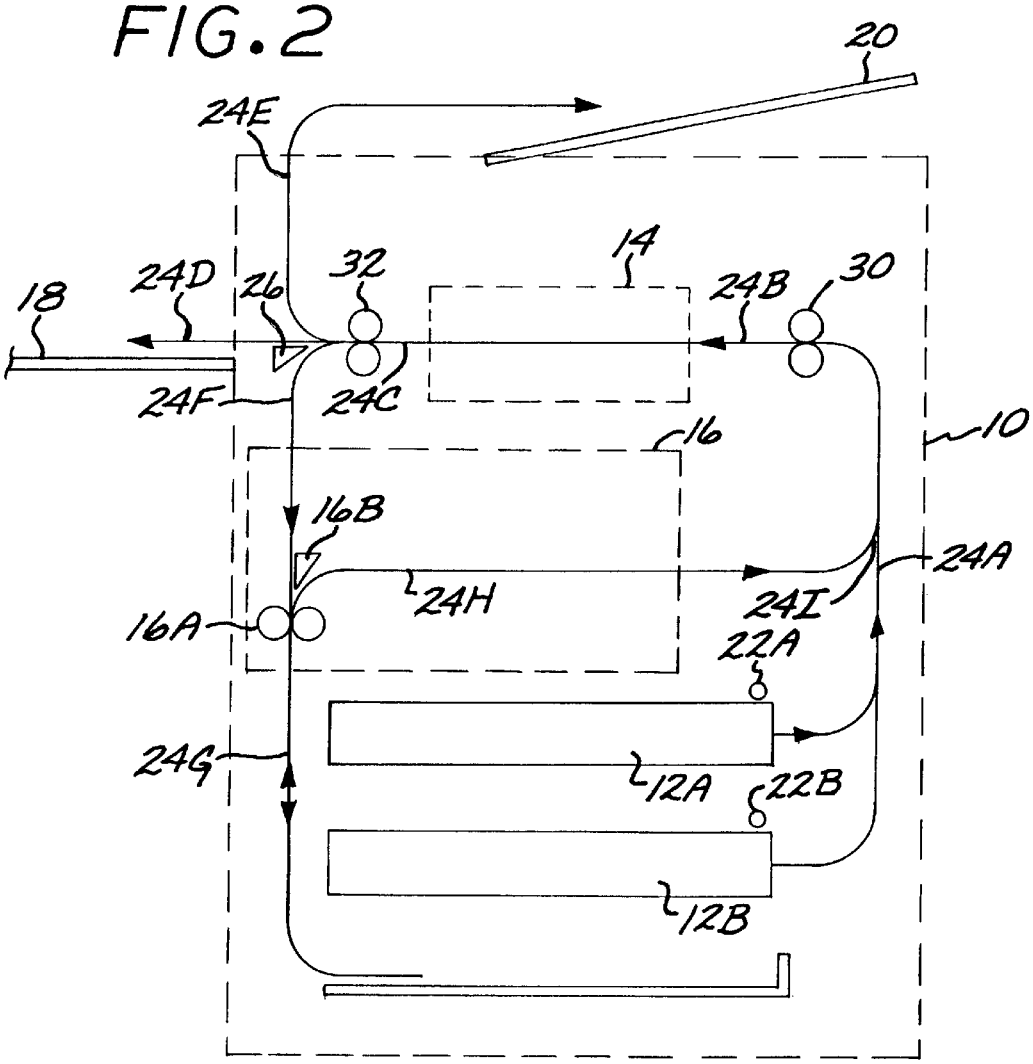
FIG. 2 is a diagrammatic illustration of the printer of FIG. 1 and the paper paths through which the print media is passed in the different printing modes.

FIG. 2 is a diagrammatic illustration of the printer 10 and the paper paths through which the print media is passed in the different printing modes. The printer in this example includes two input media sources 12A and 12B, which might be 500 sheet capacity trays, for example. A pick system represented by pick rollers 22A and 22B is provided to pick the top sheet from a given source, and deliver the picked sheet into an input media path portion 24A, which leads to the registration assembly 30. After de-skewing by the assembly 30, the print media is passed along path portion 24B to the print engine 14. The media path continues along path portion 24C to exit roller assembly 32. The media path portion exiting the roller assembly 32 divides into three path portions, including path portion 24D, 24E and 24F. Path portion 24D leads to face-up output 18. Path portion 24E leads to the face-down output 20. Path portion 24F leads to the duplexer section.

A diverter mechanism 26 is provided to direct the media sheet exiting the print engine into the appropriate path portion. Thus, for the typical face-up operation, the diverter will allow the print media exiting the print engine to enter the path 24D to the face-up output 18. For conventional face-down operation, the diverter acts to divert the sheet to the upper path portion 24E leading to output 20. For conventional duplexer operation, the diverter is actuated to direct the sheet exiting the print engine downwardly into path portion 24F.

For the duplexer mode, the sheet is driven along path portion 24F into the duplexer driver roller set 16A, into a part portion 24G until a sensor (not shown in FIG. 2) detects that the trailing edge of the sheet has passed a duplexer diverter 16B. Now the drive direction of the roller set 16A is reversed, such the trailing edge of the sheet now becomes the leading edge, which is driven to enter the path portion 24H, continuing along this path portion until it joins the path portion 24A at junction 241. It will be apparent that passing a sheet along the duplexer path portions 24F, 24G and 24H results in "flipping" the media over so that the upper surface sheet which received the print image when the sheet was passed through the print engine on the first pass is now the bottom surface when the sheet is again passed along the path portion 24A and 24B into the print engine 14.

An auxiliary print mode can be invoked in accordance with the invention to provide correct print order at the output 18, by passing the printed sheet into the duplexer path portions, and back into the input to the print engine, through the print engine without printing on the sheet, and then into the output 18.

Figure 3:
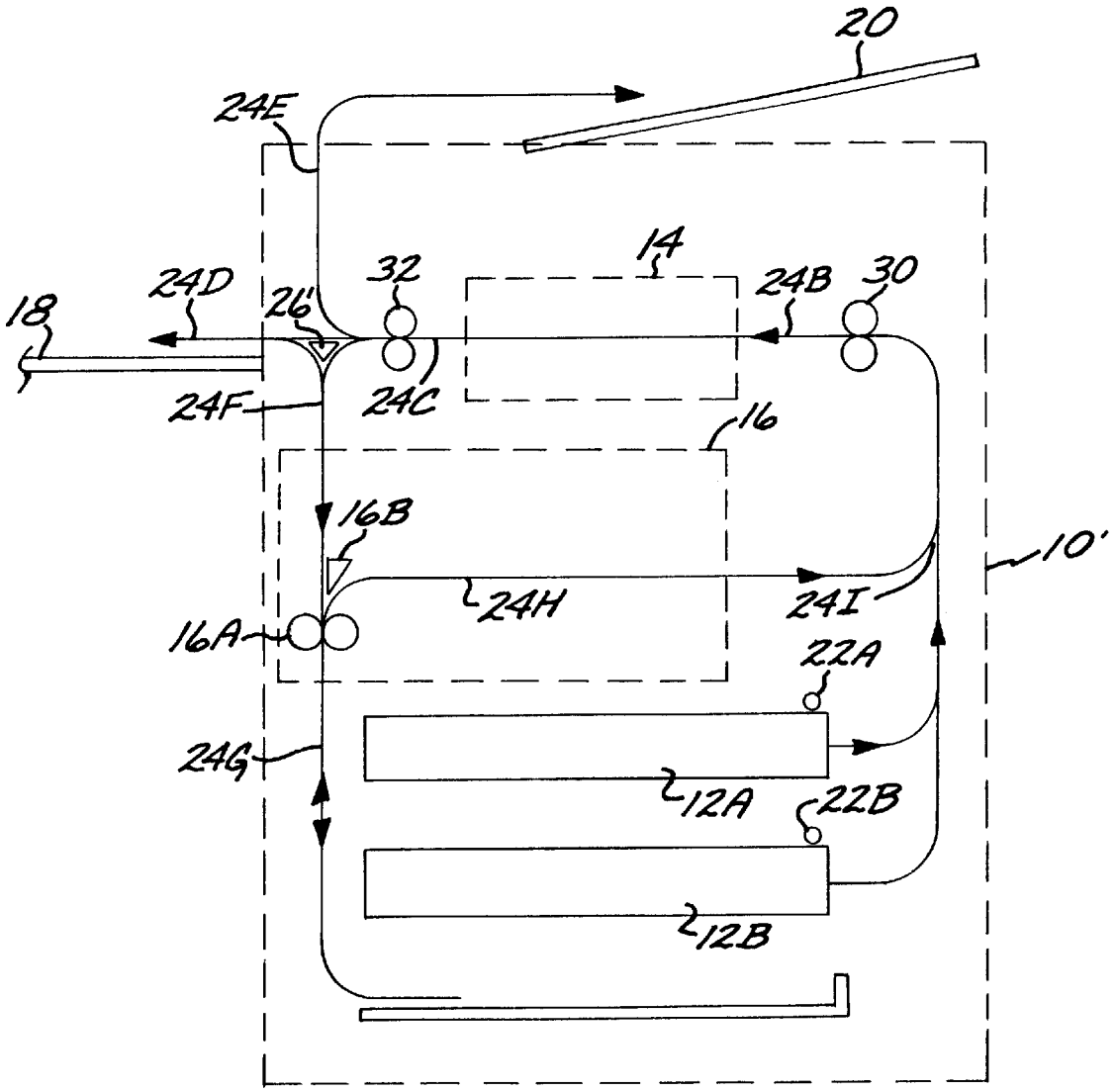
FIG. 3 is a schematic illustration of a second embodiment of a printer embodying the invention.

A second embodiment of the invention is illustrated in FIG. 3, which shows a printer 10' similar to the printer 10 of FIG. 2, except that the diverter 26' is adapted to not only direct the page into path portion 24F, but subsequently after the trailing edge of the page has passed the edge of the diverter 26' and upon reversal of the direction of rotation of the duplexer roller assembly 16A, to direct the page along path portion 24J back into the path portion 24D and to the output 18. This embodiment results in a substantially shorter travel distance to flip the page to achieve correct order output at 18.

FIGS. 4A–4D are schematic diagrams illustrating an exemplary diverter structure for diverting the page exiting the printer engine area. In this exemplary illustration, components 70, 72 and 74 define stationary respective surfaces, which define portions of the paths through which the sheets of print media can be directed. The components 70, 72 and 74 may be separate structures, or defined by a unitary structure, e.g., fabricated of an injection molded material. Opposed curved surfaces 70A and 74A of components 70 and 74 are separated to define an open channel which forms part of path portion 24H leading into the duplexer 16. Curved surface 74B and surface 72A with surface 26B' of diverter 26' define a channel forming the path portion 24F. Surface 72B and surface 26B' form a channel defining path portion 24J. The diverter structure 26' pivots about pivot point 26D', and is positionable at three stationary working positions (shown respectively in FIGS. 4B–4D) to direct the output print medium exiting the print engine to the appropriate path. In an exemplary embodiment, the default position for the diverter structure 26' is that depicted in FIG. 4B, to position surface 26A' to direct the print medium upwardly into the face down output tray 20. When the diverter structure 26' is placed in the position shown in FIG. 4D, the sheet will pass directly over surface 26C' to the face-up output 18.

Figure 4A:
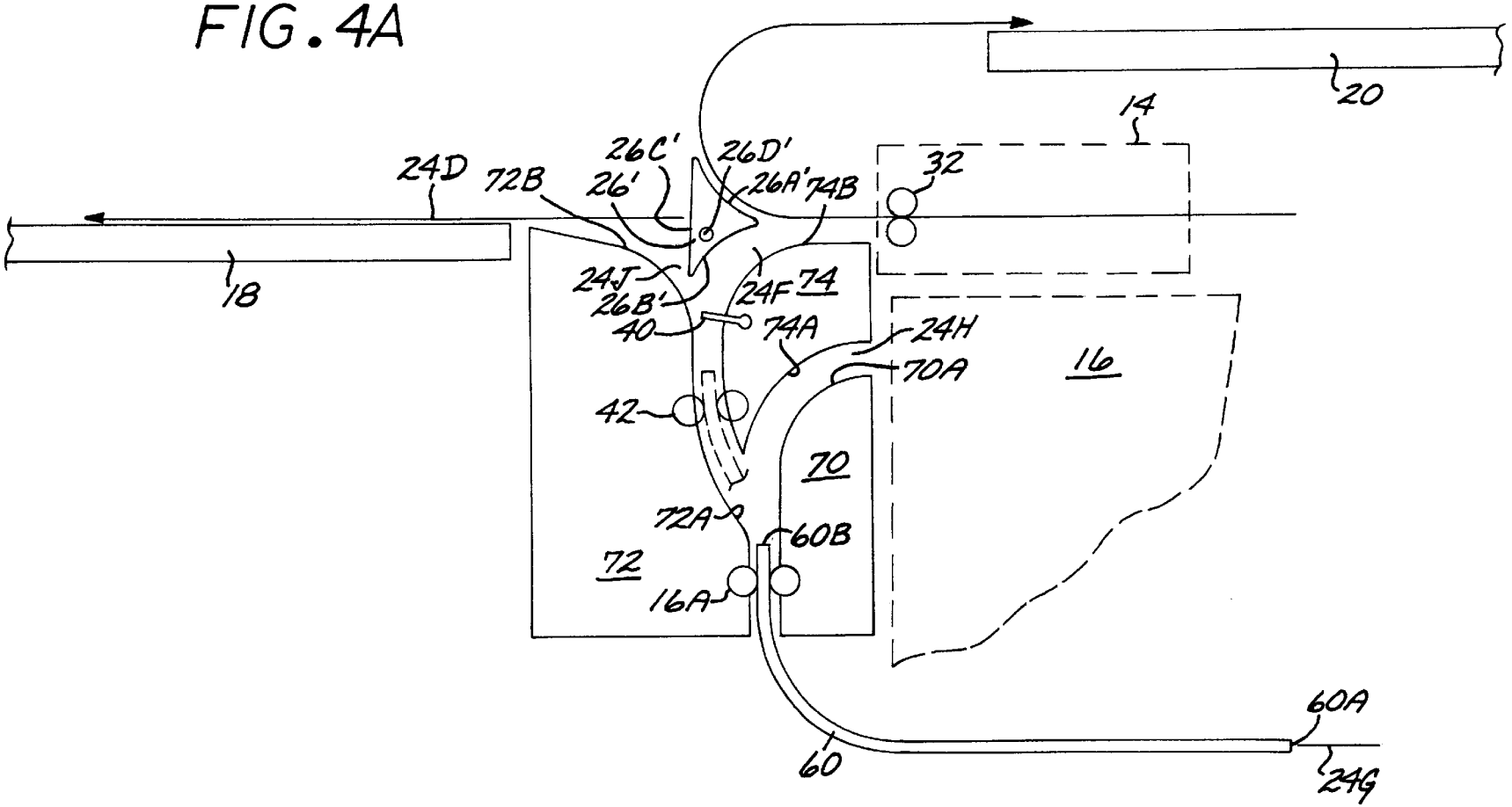
FIG. 4A is a schematic diagram illustrating an exemplary diverter structure for diverting the page exiting the print engine area of the printer of FIG. 3.
Figure 4B:
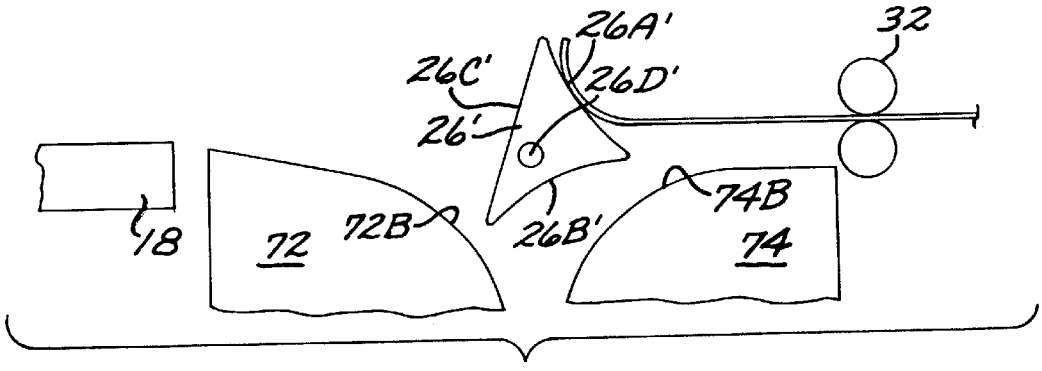
FIGS. 4B–4D illustrate three different working positions of the media diverter structure of the printer.
Figure 4C:
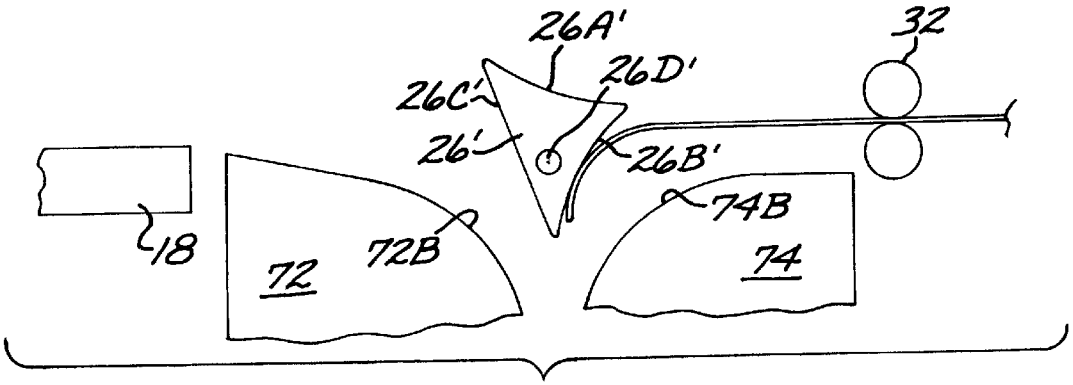
Figure 4D:
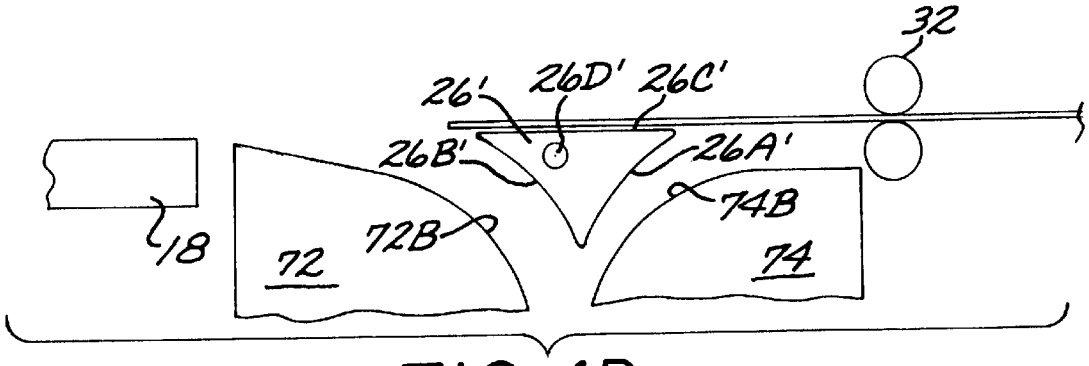
Figure 5:
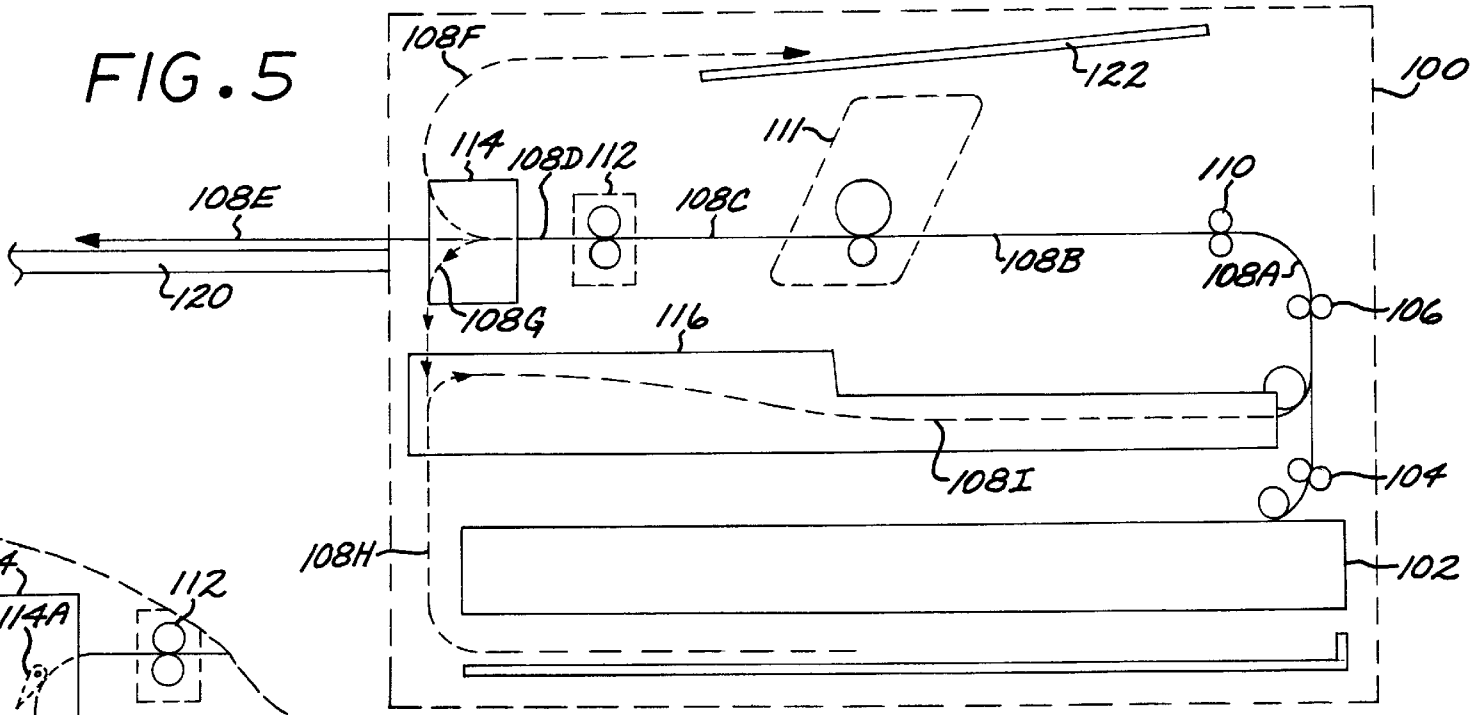
FIG. 5 is a schematic illustration of a third embodiment of a printer embodying the invention.

To divert the sheet for achieving a face-down orientation in output 18 in accordance with this invention, or for duplexing operation, the diverter 26' is positioned at the position shown in FIG. 4C, so that the leading edge 60A of the sheet exiting the print engine contacts surface 26B' and is diverted into path portion 24F such that the leading edge will enter the nip between rollers 42 and thereafter the nip between the duplexer rollers 16A. A sensor 40 is positioned to sense passage of the leading edge (60A) and trailing edge (60B) of the sheet 60. The sensor can be a mechanical vane type sensor, or other known type of sensor responsive to passage of a sheet of print media.

For duplexing operation, the sheet 60 is drawn by operation of the duplexing rollers 16A down along path 24G until the trailing edge 60B has passed the juncture of paths 24F and 24H, and after passing through the nip between rollers 42 but before the trailing edge passes through the rollers 16A. This movement can be based on a given number of motor steps or rotational movement of the rollers, or can be determined by another sensor (not shown). Now the direction of roller rotation is reversed, driving the edge 60B, now the leading edge of the sheet, upwardly into path 24H and thence back to the input to the print engine. The sheet 60 has been flipped, so that the surface printed on the previous pass through the print engine now faces downwardly, and the unprinted surface is in position to receive the printed image. After printing, the sheet 60 will be passed through the print engine 14 to either the face-up output 18 or the face-down output 20, or by use of the correct order mode as described below to path 24F, as determined by the commanded position of the diverter 26'.

To achieve the correct (face-down) order at output 18 in accordance with the invention, after the sheet 60 has been diverted into path portion 24F and into the duplexer roller nip, the sensor 40 is again used to determine passage of the trailing edge 60B. The diverter 26' is moved back to the downward position. Now the direction of rotation of rollers 42 is reversed, so that the edge 60B is now the leading edge. The sheet is passed along path portion 24J to the output 18. The orientation of the sheet has been flipped, so that the printed surface faces down and the print output for a single sheet or for a multi-sheet job will be in correct order.

With the technique illustrated in FIGS. 3 and 4, a second face-down output can be provided at output 18. This second output is particularly useful when an output device is assembled to the printer at output 18, as represented by phantom line 19. Exemplary output devices include sorters, stackers and stapler systems. Now these devices do not need to include a flipper apparatus to flip the orientation of sheets received at output 18, since the printer can be controlled to provide sheet outputs in either a face-up or a face-down orientation.

The diverter structure and path defining components shown in FIGS. 4A–4D illustrate an exemplary apparatus for implementing the invention, but other structures and apparatus can be devised by those skilled in the art. For example, multiple diverter devices can be used instead of a single structure 26' to divert the sheet into the different paths.

FIGS. 5–8 illustrate a third embodiment of a printer employing the invention. The printer 100 includes an input tray 102, from which sheets are picked and transported by a pick and transport mechanism 104 into a path portion 108A, using techniques which are well known in the art. The leading edge of the picked sheet is advanced into the registration assembly 110 for de-skewing, and then along path 108B into the print engine including in this example an electrophotographic recording apparatus 111 and a fuser assembly 112. After passing through the recording apparatus 111, the sheet proceeds along path portion 108C to the fuser assembly 112, and then along path 108D to a diverter assembly 114. The diverter assembly can allow the sheet to proceed along straight path portion 108E to output area 120, to upwardly curved path portion 108F to output area 122 or to downwardly curved path portion 108G to the duplexer 116 or for an orientation reversal or flipping, as well be explained in more detail with respect to FIG. 8.

Figure 6:
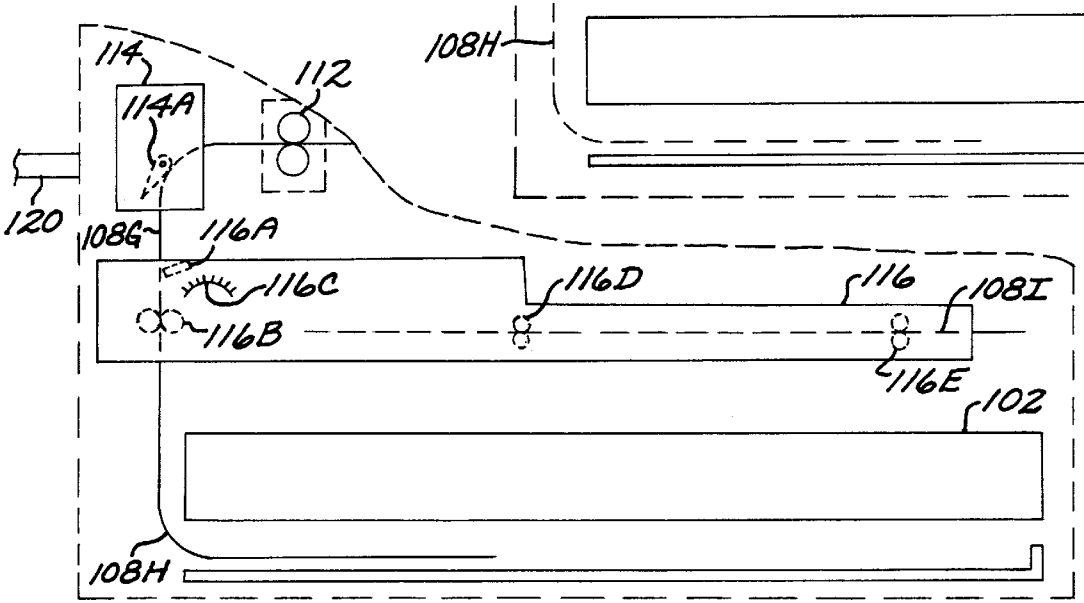
FIGS. 6 and 7 illustrate the duplexer operation of the printer of FIG. 5, for double-sided printing.
Figure 7:
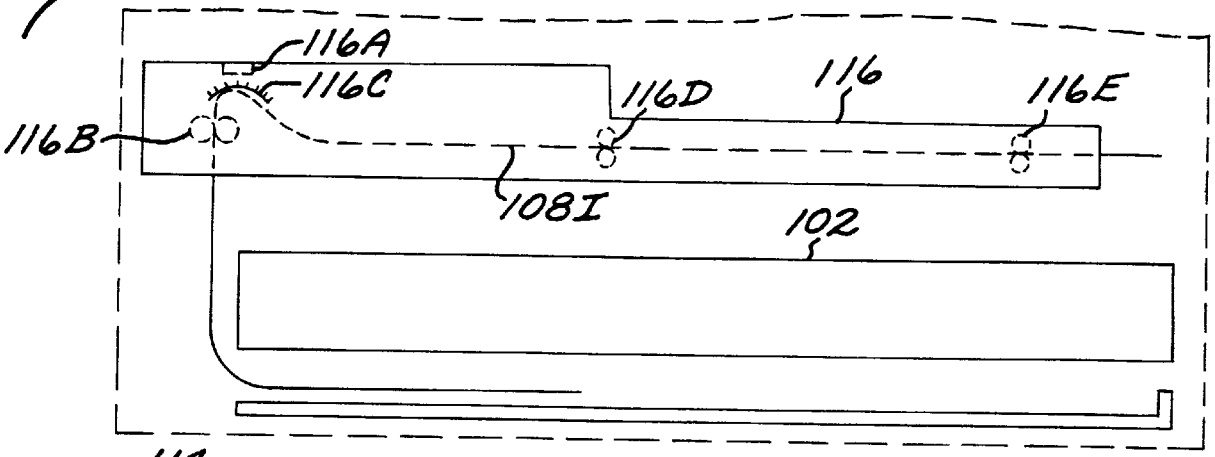

FIGS. 6 and 7 illustrate the duplexer operation of the printer 100, for double-sided printing. In this case, the diverter assembly 114 diverts the leading edge of the sheet downwardly into path portion 108G, entering the duplexer 116. When the trailing edge of the sheet passes the sensor 118, the transport rollers 116B are turned a predetermined number of steps so that the trailing edge is below the guide 116C, but still in the nip of the transport rollers. At this time, the feed direction of the transport rollers 116B is reversed, and the trailing edge of the sheet, now the leading edge, is transported under the guide 116C. This motion is aided by the angle of contact of the transport rollers 116B, which tends to move the paper to the right as well as upwardly. Now the sheet is guided by guide 116C to follow path 1081, and is transported through the duplexer to the path portion 108A, and back to the print engine. Second and third sets 116D and 116E of transport rollers engage the sheet and drive it along path portion 1081 and into the merger with path portion 108A, as generally shown in FIG. 7. The orientation of the sheet has been reversed, so that the previously unprinted surface of the sheet is now positioned for printing by the print engine.

Figure 8:
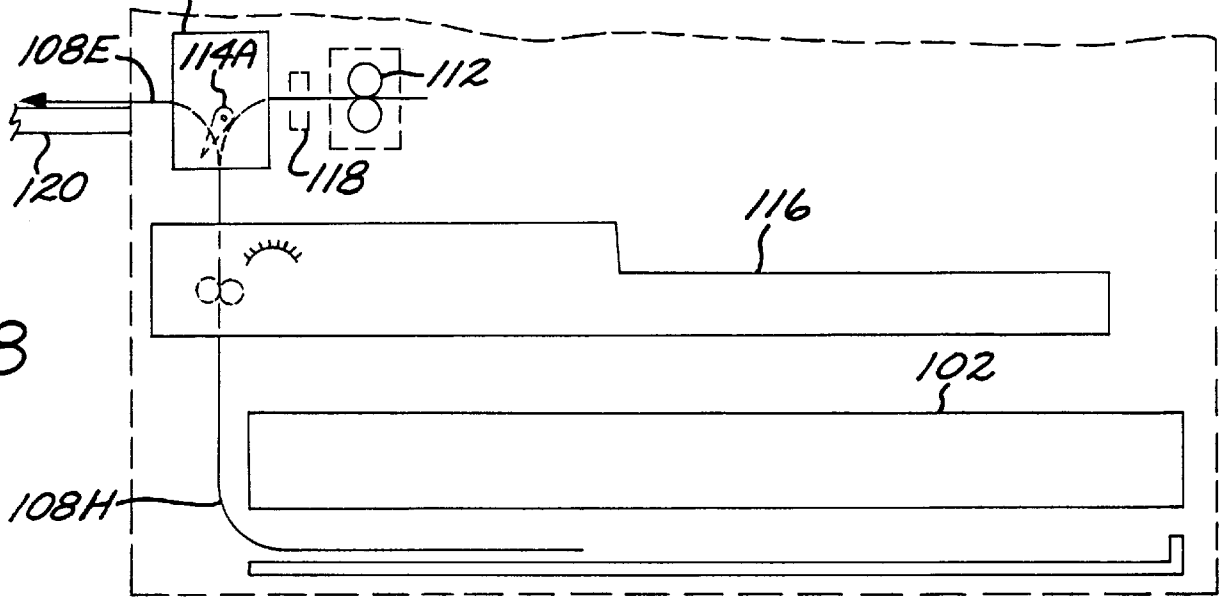
FIG. 8 illustrates the correct order, face down mode of operation for the printer of FIG. 5.

To achieve correct ordering of a print job at output 120 in accordance with the invention, the sheet will be moved into the duplexer 116, but instead of passing the sheet under the guide and toward the input of the printer, the sheet is instead directed upwardly toward output 120. This is shown in FIG. 8. The sheet is fed, leading edge first, down through the duplexer as before. Once the trailing edge of the sheet is detected by the sensor 118, the sheet continues to be transported downwardly a fixed number of steps until the trailing edge is known to be past the diverter assembly 114. At this point, the diverter vane 114A is repositioned, and the duplexer transport rollers reverse direction to feed the sheet upwardly. The diverter vane is now positioned to divert the leading edge of the sheet toward the output 120. The sheet is now in a face-down, correct order orientation.

Figure 9:
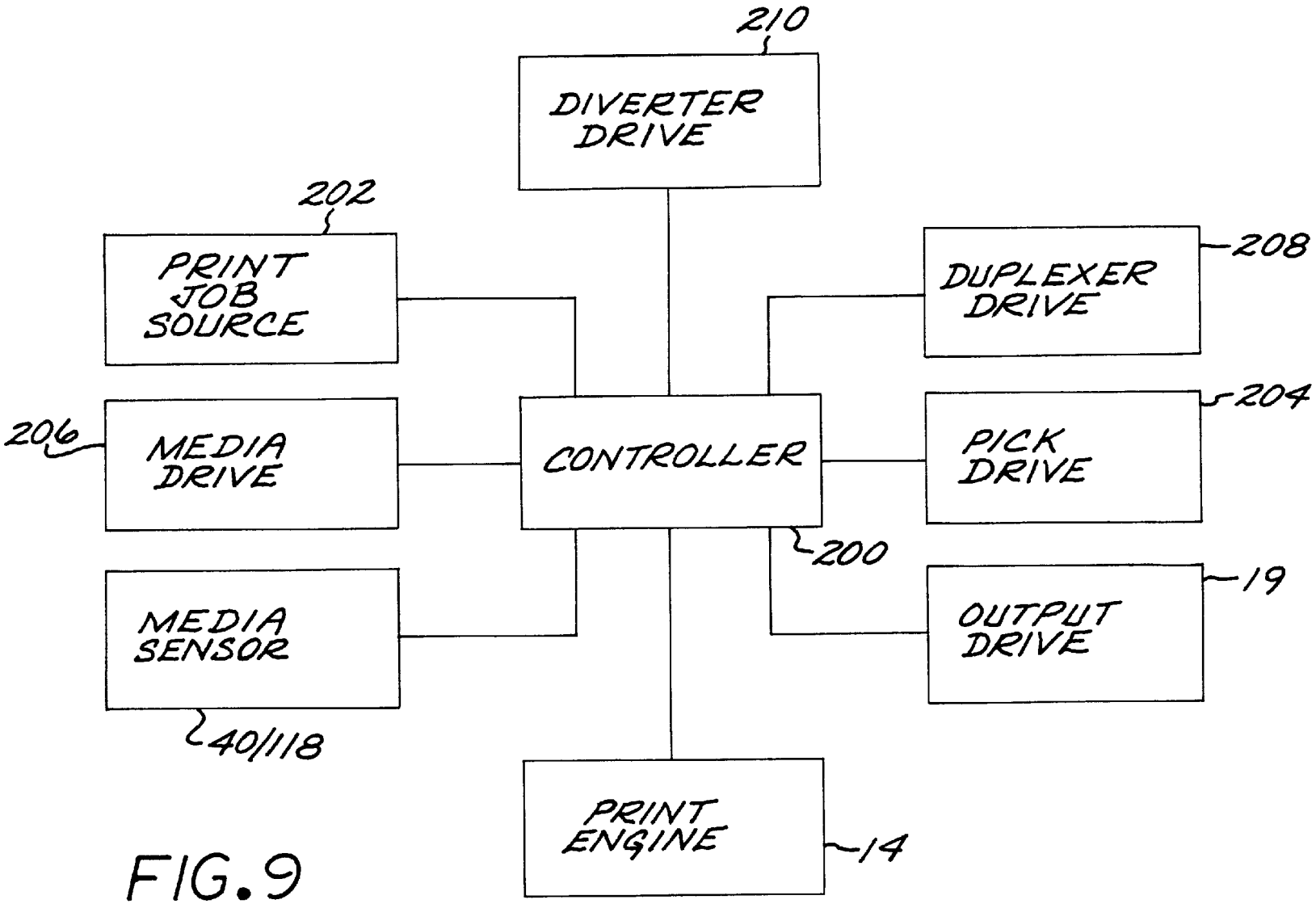
FIG. 9 is a control block diagram illustrating exemplary control features of a printer embodying the invention.

FIG. 9 is a control block diagram illustrating exemplary control features of a printer embodying the invention. The printer includes a controller 200, which can be a microprocessor, ASIC, discrete logic or other type of electronic control system. The controller 200 provides appropriate drive signals to the print engine 14 for print jobs received from a print source 202, which can be a personal computer, workstation, digital camera, or other print sources. The controller activates and controls the pick drive 204 to pick sheets from the input media source such as the input tray 12 (FIG. 1). The media drive 206 drives the print media along the media path, and to the output locations. The duplexer drive 208 is controlled when the printer is in a duplexer mode, or in a mode to achieve correct face-down order in the case of printer 10 described with respect to FIGS. 1–2. The diverter drive 210 is provided for the printers of FIGS. 3–8, and positions the diverter structure 26 and 26' in the appropriate positions for the different operating modes. The controller also receives sensor signals from the media sensors 40/118.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A method for achieving correct order orientation of a multiple page print job in a printer having a duplexing function, a normally face up output area and a normally face down output area, comprising:

(i) printing a page of the print job at a print area;

(ii) passing the page through a duplexing media path to reorient the first page in a page down orientation;

(iii) passing the page through the print area in the page down orientation without conducting a printing operation;

(iv) passing the page from the print area to the normally face up output area in face down, correct order orientation; and (v) repeating steps (i)–(iv) for each page of said multiple page print job.

2. The method of claim 1 wherein said step of printing the page of the print job includes passing the page through an electrophotographic print engine and transferring an image onto a surface of the page.

3. The method of claim 1 wherein said step of printing the page of the print job includes passing the page through an ink-jet print engine and ejecting droplets of ink onto the page to form an image.

4. The method of claim 1 wherein said printing the page of the print job at a print area includes passing the page through an electrophotographic print engine and transferring an image onto a surface of the page.

5. The method of claim 1 wherein said printing the page of the print job at a print area includes passing the page through an ink-jet print engine and ejecting droplets of ink onto the page to form an image.

6. A method for printing a multiple page print job in a printer having a face-down output location and a normally face-up output tray, comprising:

printing a page of the print job at a print area;

passing the page from the print area to the face-down output tray if the printer is in a first operating mode;

passing the page from the print area to the normally face-up output location in a face-up orientation if in a second operating mode;

passing the page from the print area through an orientation reversing media path and then to the normally face-up output location in a face-down orientation if in a third operating mode;

passing the page from the print area after printing on a first side of the page to a duplexing path for reversing the orientation of the page, then back to the print area for printing on a second side of the page, if in a fourth operating mode; and repeating each of the foregoing steps for each remaining page of the multiple page print job.

7. The method of claim 6 wherein said printing the page of the print job includes passing the page through an electrophotographic print engine and transferring an image onto a surface of the page.

8. The method of claim 6 wherein said printing the page of the print job includes passing the page through an ink-jet print engine and ejecting droplets of ink onto the page to form an image.

9. A method for printing a multiple page print job in a printer having a face-down output location, a normally face-up output location, and a duplexer function including a duplexing media path to reverse the orientation of the page and pass the reoriented page through the print area again, comprising:

printing a page of the print job at a print area;

passing the page from the print area to the face-down output location if the printer is in a first operating mode;

passing the page from the print area to the normally face-up output location in a face-up orientation if in a second operating mode;

passing the page from the print area through an orientation reversing media path and then to the normally face-up output location in a face-down orientation if in a third operating mode, comprising passing the page through the duplexing media path to reorient the page in a page down orientation, and passing the page through the print area in the page down orientation without conducting a printing operation; and repeating each of the foregoing steps for each remaining page of the multiple page print job.

10. The method of claim 9 further including positioning a diverter structure in a print engine output path at a first position if the printer is in the first operating mode, in a second position if the printer is in the second operating mode, or in a third position if the printer is in the third operating mode.

11. The method of claim 9 wherein said printing the page of the print job at a print area includes passing the page through an electrophotographic print engine and transferring an image onto a surface of the page.

12. The method of claim 9 wherein said printing the page of the print job at a print area includes passing the page through an ink-jet print engine and ejecting droplets of ink onto the page to form an image.

* * * * *